US010407806B2

(12) United States Patent
Sullivan

(10) Patent No.: US 10,407,806 B2
(45) Date of Patent: Sep. 10, 2019

(54) YARN-CARRYING AND DISPENSING APPARATUS

(71) Applicant: PRYM CONSUMER USA INC., Spartanburg, SC (US)

(72) Inventor: Kathleen Sullivan, Cooperstown, NY (US)

(73) Assignee: PRYM CONSUMER USA INC., Spartanburg, SC (US)

( * ) Notice: Subject to any disclaimer, the term of this patent is extended or adjusted under 35 U.S.C. 154(b) by 128 days.

(21) Appl. No.: 15/793,794

(22) Filed: Oct. 25, 2017

(65) Prior Publication Data

US 2018/0112338 A1 Apr. 26, 2018

Related U.S. Application Data

(60) Provisional application No. 62/412,637, filed on Oct. 25, 2016.

(51) Int. Cl.
*D04B 3/06* (2006.01)
*B65D 13/02* (2006.01)
(Continued)

(52) U.S. Cl.
CPC ..... *D04B 3/06* (2013.01); *B65D 7/04* (2013.01); *B65D 7/26* (2013.01); *B65D 11/02* (2013.01);
(Continued)

(58) Field of Classification Search
CPC ..... D04D 3/06; B65H 49/00; B65H 49/38; B65H 18/28; B65H 54/64; B65D 7/04;
(Continued)

(56) References Cited

U.S. PATENT DOCUMENTS 1,983,116 A * 12/1934 Biberman ..... D05B 1/14 220/506
2,125,267 A * 8/1938 Bekan ..... D04B 3/06 242/146

(Continued)

OTHER PUBLICATIONS

Transmittal; International Search Report; and the Written Opinion of the International Searching Authority for International Application No. PCT/US2017/058344 dated Jan. 9, 2018.

(Continued)

*Primary Examiner* — Ismael Izaguirre

(74) *Attorney, Agent, or Firm* — J. Bennett Mullinax, LLC

(57) ABSTRACT

Described herein are embodiments of a yarn-carrying and dispensing apparatus. The embodiments described allow knitters to easily transport, carry and use balls of yarn for knitting and other knitting materials. The embodiments prevent the ball of yarn from rolling away or getting tangled or intertwined. The embodiments also easily and smoothly dispense the yarn, making the knitting more efficient and easier for the knitter. The embodiments provide additional elements to accommodate a knitter: (i) a ruler allowing, for example, to measure a knitting sampler; (ii) a needle gauge and needle openings, allowing, for example, to measure the size of a needle; and (3) an insert allowing, for example, to hold one or more balls of yarn.

20 Claims, 12 Drawing Sheets

(51) Int. Cl.

| | |
|---|---|
| ***B65D 25/04*** | (2006.01) |
| ***B65D 85/67*** | (2006.01) |
| ***B65D 8/00*** | (2006.01) |
| ***B65D 6/18*** | (2006.01) |
| ***B65D 6/16*** | (2006.01) |
| ***B65D 25/32*** | (2006.01) |

(52) U.S. Cl.
CPC ..... *B65D 11/18* (2013.01); *B65D 13/02* (2013.01); *B65D 25/04* (2013.01); *B65D 25/32* (2013.01); *B65D 85/67* (2013.01)

(58) Field of Classification Search
CPC ..... B65D 7/26; B65D 11/02; B65D 11/18; B65D 13/02; B65D 25/04; B65D 25/32; B65D 85/67
USPC ..... D9/419, 420; D15/78; D3/20, 23, 315
See application file for complete search history.

(56) References Cited

U.S. PATENT DOCUMENTS

| | | | | | |
|---|---|---|---|---|---|
| 2,169,297 | A * | 8/1939 | Smith | B65D 11/02 | 223/107 |
| 2,304,501 | A | 12/1942 | Homer | | |
| 2,519,505 | A * | 8/1950 | Rollins | D04B 3/06 | 242/137.1 |
| 2,673,669 | A * | 3/1954 | Hawkins | D05B 1/14 | 223/107 |
| 2,710,689 | A | 6/1955 | Prossen | | |
| 3,084,788 | A * | 4/1963 | Ford | D04B 3/00 | 206/383 |
| 5,150,794 | A * | 9/1992 | Rooks | D04B 3/06 | 206/388 |
| 8,602,342 | B2 * | 12/2013 | Sullivan | F16D 69/026 | 223/107 |
| 2009/0218245 | A1 * | 9/2009 | Arnoff | B65H 49/08 | 206/392 |
| 2011/0089063 | A1 | 4/2011 | Sullivan | | |
| 2012/0223087 | A1 | 9/2012 | Wang | | |

OTHER PUBLICATIONS

International Search Report; dated Jan. 1, 2018; 3 pages.

* cited by examiner

YARN-CARRYING AND DISPENSING APPARATUS

RELATED APPLICATIONS

The present application claims priority to U.S. Provisional Patent Application Ser. No. 62/412,637, entitled "AN IMPROVEMENT OF A YARN-CARRYING AND DISPENSING APPARATUS," and filed Oct. 25, 2016, which is hereby incorporated by reference in its entirety.

FIELD OF INVENTION

The present inventions relates to a yarn-carrying and dispensing apparatus, including a removable insert containing a dividing wall, needle openings for a needle gauge, and a carrying strap.

BACKGROUND

Many people like to knit, whether as a hobby or a profession. Whether a professional or hobby knitter, all who knit suffer from the same dreaded problem: controlling a ball of yarn from tangling and containing it in a manner that keeps the yarn clean and safe from pets and children's curiosity.

No matter how careful a knitter is or how securely the knitter thinks they have corralled the ball of yarn, eventually the ball gets away from the knitter and finds its way onto the floor. Once on the floor, the ball of yarn will often roll across floor. When this happens, aside from the risk of becoming intertwined with other yarn, the ball of yarn may become "spoiled" by getting dirty from the floor. The ball of yarn is subjected to any and all bits and pieces of whatever debris is on the floor; lint, dirt, and the worst of worst, dreaded pet hairs. Aside from being very frustrating, spoiled yarn can result in a finished product that must now be washed or picked clean before wearing it or passing it on to the intended recipient.

Moreover, almost all who knit like to take their knitting with them when they know they will have some down time that will allow them to continue to work on their project. Knitters often knit while waiting for appointments such as in doctors, dentists or business offices, while sitting around for kids to finish sports, or school projects, while riding the bus or train to work and even while they have wait time on line for appointments like at motor vehicle office. Those who travel, either on vacation or business, especially love to take their knitting along with them. They knit while in the car, on the plane, riding the train, or on the bus, etcetera. Then once at their destination, such as the beach or in the hotel, they again pick up their beloved knitting. Unfortunately, when knitting on the go or at home, most knitters carry their yarn in big bulky yarn bags or baskets. The ball of yarn necessary for knitting can get tangled in the material bag, intertwined and tangled with other yarn or knitting materials in the bag.

An important technique of the art of knitting is to keep the gauge steady and even. This is so the knitted work has a smooth professional look and finish to it. Even the occasional knitter strives for this. If the knitter is constantly pulling to release the next length of yarn from a tangled ball, which happens constantly while trying to secure the ball, it makes it much harder to maintain that smooth even gauge.

Unfortunately, these problems with knitting prevent or discourage many knitters from bringing their knitting material with them when traveling and from knitting. There are no known devices for easily transporting and holding yarn while a knitter knits.

U.S. Pat. No. 8,860,342, which is herein incorporated by reference, describes a yarn carrying and dispensing apparatus including a substantially hollow sphere shaped yarn carrying portion that substantially envelopes a single yarn ball.

SUMMARY OF THE INVENTION

An advantage of embodiments described herein is that they overcome disadvantages of the prior art because they are capable of accommodating a plurality of balls of yarn, they include a removable insert, needle gauges, and a ruler. These and other advantages are provided by a yarn-carrying and dispensing apparatus, comprising a substantially hollow yarn-carrying portion that accommodates at least one ball of yarn, the yarn-carrying portion having a top portion, and bottom portion, wherein the top portion and bottom portion are connected to each other by one of a joint or a hinge; a disk shaped removable insert adapted to fit inside the yarn-carrying portion, the removable insert having a dividing wall formed on a surface of the removable insert, so that at least one ball of yarn can sit on the surface of the removable insert on either side of the dividing wall; and an annular shaped collar portion, the collar portion adapted to be removably secured to a base portion for allowing the yarn-carrying portion to sit on a surface.

These and other advantages are also provided by a yarn-carrying and dispensing apparatus, comprising a substantially hollow yarn-carrying portion that accommodates at least one ball of yarn, the yarn-carrying portion having a top portion, and bottom portion, wherein the top portion and bottom portion are connected to each other by one of a joint or a hinge; wherein the yarn-carrying portion includes one or more yarn dispensing holes through which the yarn is dispensed from the yarn-carrying portion; and a skein and cone tool adapted to fit inside of the yarn-carrying portion, the skein and cone tool comprising a rod and two removable wheels, each removable wheels configured to fit securely between the top and bottom portion, and to connect to each end of the rod; wherein the skein and rod tool is adapted to stab one of a skein or cone of yarn, such that the skein or cone of yarn may rotate about the rod when yarn from one of the skein or cone of yard is dispensed through the one or more yarn dispensing holes in the yarn-carrying portion.

BRIEF DESCRIPTION OF THE DRAWINGS

The detailed description will refer to the following drawings, wherein like numerals refer to like elements, and wherein.

DETAILED DESCRIPTION

Described herein are embodiments of a yarn-carrying and dispensing apparatus. The embodiments described allow knitters to easily transport, carry and use balls of yarn and other knitting equipment, such as needles and scissors. The embodiments prevent balls of yarn from rolling away or getting tangled or intertwined. The embodiments describe an apparatus that easily and smoothly dispenses the yarn, making knitting more efficient and easier on the go.

Figure 1:
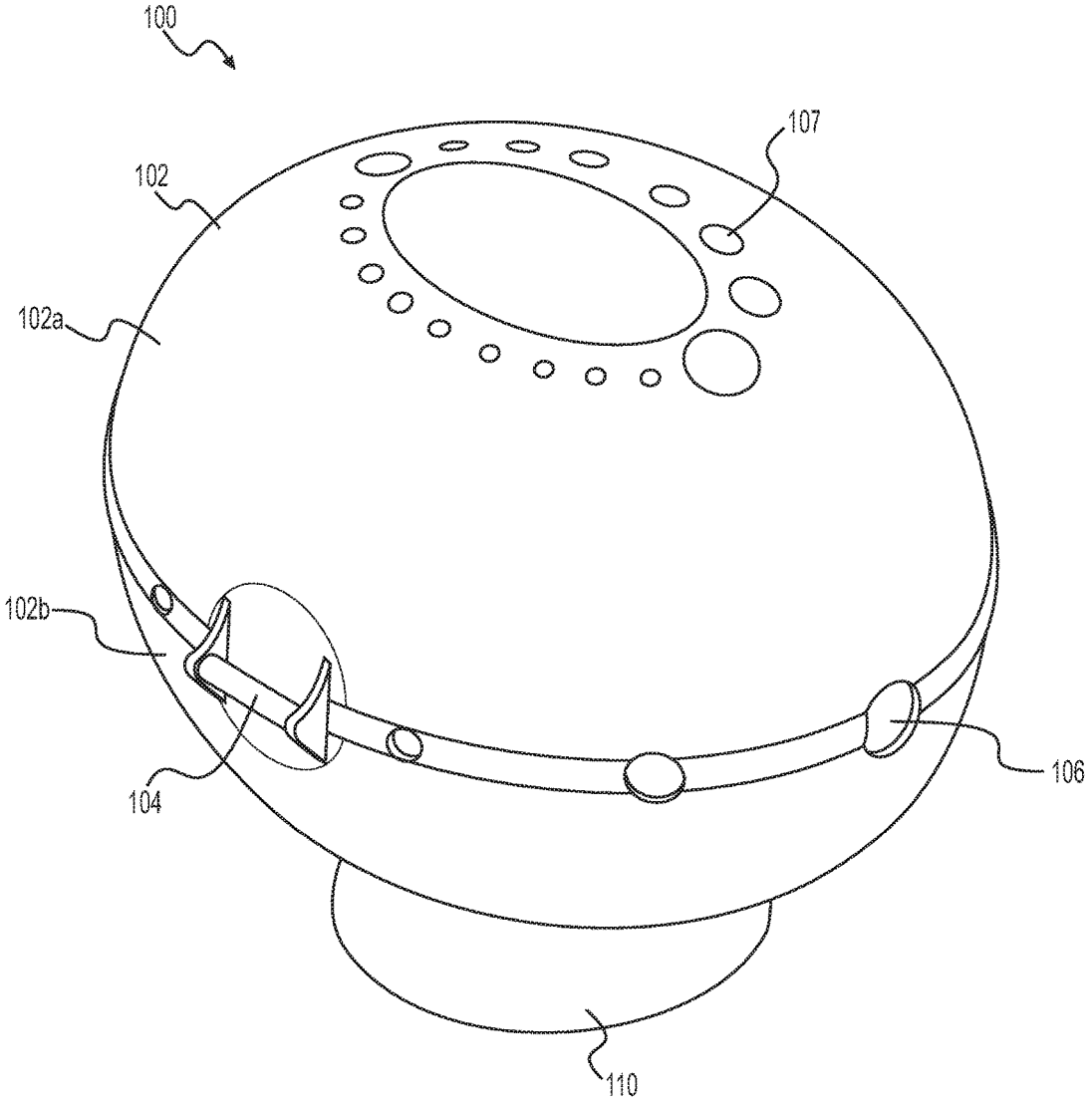
FIG. 1 is a view of an embodiment of a yarn-carrying and dispensing apparatus

With reference to FIG. 1, shown is an embodiment 100 of a yarn-carrying and dispensing apparatus. The embodiment 100 of the yarn-carrying and dispensing apparatus includes a substantially hollow yarn-carrying portion 102. The yarn-carrying portion 102 in this embodiment shown is oval shaped. Such a shape accommodates a user to separate the yarn-carrying portion into a multiple portions that will allow a knitter to have more than one yarn in the yarn-carrying portion 102. Other shaped yarn-carrying portions, such as spherical or cylindrical-shaped portions, that can accommodate differently shaped yarn gatherings such as yarn rolled on a tube or inverted cone, may be included in the yarn-carrying and dispensing apparatus. Alternatively, cubic-shaped, column-shaped or other-shaped yarn balls may be used (if flat-bottomed, collar and base portions described below may be omitted).

In the embodiment shown in FIG. 1, the yarn-carrying portion 102 is a hollow plastic oval shaped ball of approximately eight (8) inches long and six (6) inches wide. A variety of sized yarn-carrying portions may be used, including larger or smaller sized oval shapes. Plastic is a useful material for the yarn-carrying portion 102, as it is lightweight and easily obtainable, but other materials may be used such as glass, cardboard, or metals. Another advantage of plastic is that it may be transparent; accordingly, the embodiment shown is transparent, allowing the knitter to see how much yarn is remaining. However, the yarn-carrying portion may be opaque or translucent. The yarn-carrying portion 102 is typically lightweight enough to be easily carried, e.g., in a purse, bag, or pocket.

The yarn-carrying portion 102 may be subdivided into a top portion 102*a* and a bottom portion 102*b*. The top portion 102*a* may include a needle gauge including a plurality of needle openings 107, where the diameter of each needle opening 107 corresponds to a different needle size. Advantageously, the size of the diameter of each needle opening 107 may correlate to various commonly used industry standard needle sizes. For example, the sizes of each needle opening 107 may correspond to commonly used needle sizes, such as the contemporary U.S. Size, contemporary U.K./U.S. Metric Range, the European Metric Range, or any other known needle measuring system. Further, as depicted in FIG. 1, each needle opening 107 may be arranged along the same line surrounding an upper curvature of the top portion 102*a*. FIG. 1 shows that the needle openings 107 may be arranged such that each adjacent needle opening 107 is one size larger or smaller than its neighboring needle opening 107. In this arrangement, the largest and smallest needle opening may also be positioned next to one another. Such an arrangement is advantageous because it allows a knitter to easily identify a needle thread size.

With continued reference to FIG. 1, the yarn-carrying portion 102 will typically have a hinge 104 that allows the top portion 102*a* and bottom portion 102*b* to open and close, around the hinge, so that the balls of yarn or other knitting equipment may be placed inside. The two portions of the yarn-carrying portion, 102*a* and 102*b*, may also be connected via a joint (a joint is not shown on FIG. 1, but was illustrated in U.S. Pat. No. 8,860,342). The two portions of the yarn-carrying portion 102 may also have a "door" or other opening that allows the yarn to be placed into the yarn-carrying portion 102.

The yarn-carrying portion 102 shown may also include plurality of yarn-dispensing holes or openings 106 for allowing a knitter to dispense yarn. These holes or openings 106 positioned along the largest circumference of the oval shaped ball, through which the yarn exits or dispenses from the yarn-carrying portion 102, as shown. The yarn-carrying portion 102 may only have one yarn-dispensing hole or opening 106, or a plurality of yarn-dispensing holes or opening 106 in different locations other than along the largest circumference of the yarn carrying ball, that may enable the yarn to dispense at different angles and positions from the yarn-carrying portion 102. The yarn-dispensing holes or openings 106 may be of large enough diameter to pass the yarn easily through without significant resistance.

With continued reference to FIG. 1, the embodiment 100 of the yarn-carrying and dispensing apparatus also includes a yarn-carrying collar portion (not shown), e.g., ball collar. The yarn-carrying collar portion is typically affixed to a portion of the yarn-carrying portion 102 (e.g., at the bottom). In the embodiment shown, the yarn-carrying collar portion serves multiple functions. The yarn-carrying collar portion provides a mechanism for connecting the yarn-carrying portion 102 to a base portion 110. The yarn-carrying collar portion also provides a mechanism for connecting the yarn-carrying portion 102 to straps or other device that enables the user to easily carry around the yarn-carrying and dispensing apparatus. With straps (not shown) attached to the yarn-carrying collar portion, a knitter may knit while standing with the yarn-carrying and dispensing apparatus 100 hanging from the knitter's shoulder and dispensing yarn.

The yarn-carrying collar portion may include threads, latches or simply be sized to snugly fit in the base portion 110 (alternatively, the yarn-carrying portion 102 may connect directly to the base portion 110, omitting the collar portion). The yarn-carrying collar portion may be affixed to the yarn-carrying portion 102 in any of a variety of known manners.

The yarn-carrying collar portion may also be sized to fit snuggly in standard or non-standard drink holders in vehicles, trains, planes, etc. This enables the knitter to use the yarn-carrying and dispensing apparatus 100 and knit while traveling on such.

With continued reference to FIG. 1, the embodiment 100 of the yarn-carrying and dispensing apparatus shown includes a base portion 110. The base portion 110 is typically weighted and with a flat bottom so that the yarn-carrying and dispensing apparatus can easily and securely sit on a surface, such as a table or a knitters lap. The base portion 110 is typically weighted substantially enough to hold the yarn-carrying and dispensing apparatus in place when yarn is dispensed from the yarn-carrying portion 102. Accordingly, the base portion 110 may be made from glass or other such substantially heavy material to hold the yarn-carrying and dispensing apparatus in place. Further the base portion 110 may contain storage space such that a knitter can store knitting equipment.

The base portion 110 and the ball portion 102 (the yarn-carrying portion) are typically designed to easily come apart so that the knitter may travel with just the yarn-carrying portion 102, or separately carry both.

Figure 2:
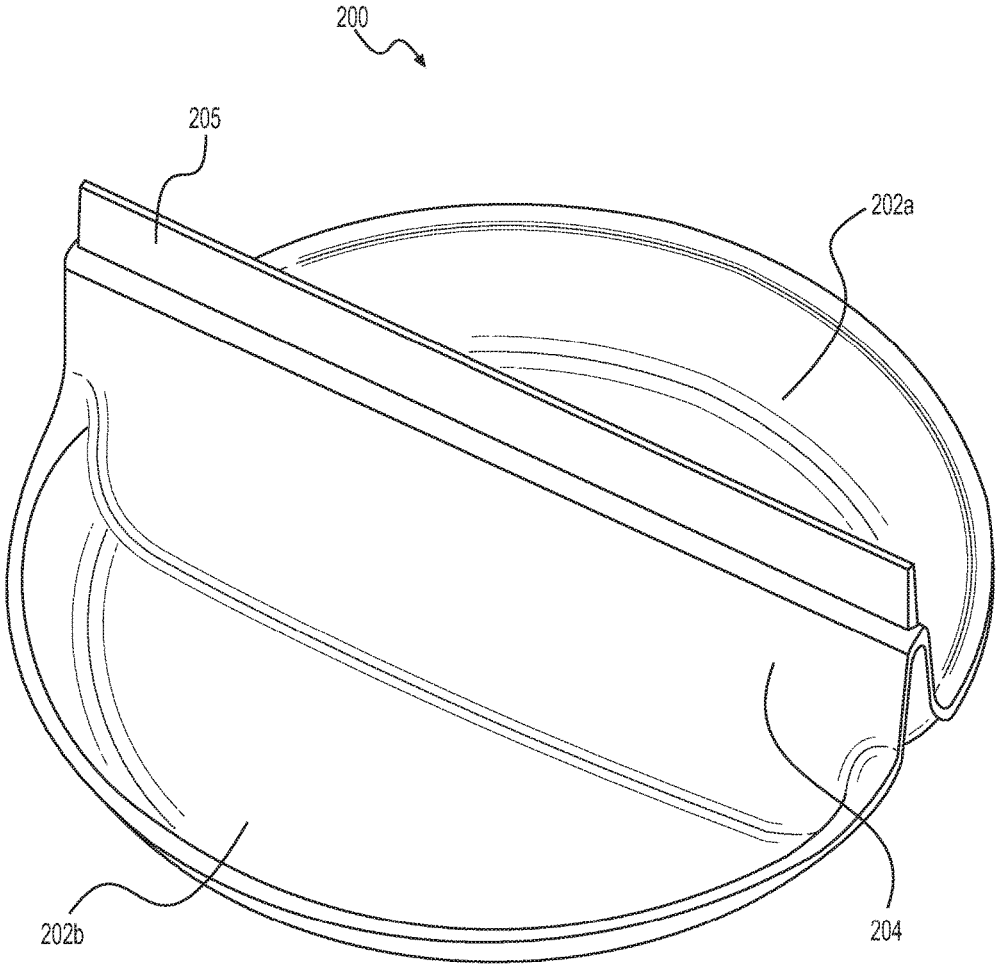
FIG. 2 illustrates an insert tray that may be placed inside of the yarn-carrying portion to separate the yarn-carrying portion in multiple sections for convenience of a user.

An insert 200 may be placed within the yarn-carrying portion 102. As depicted in FIG. 2, the insert 200 is preferably disc-shape and, as will be discussed in reference to FIG. 3, the outer edge of the insert 200 may be the same shape and size as the inside of the bottom portion 102*b* such that the insert 200 fits snuggly within the bottom portion 102*b* of the yarn-carrying portion 102. A mechanism, such as a latch or hook, may also be installed to the inner part of the bottom portion 102*b*, to secure the insert in place and prevent it from moving inside of the yarn-carrying portion 102. Plastic is a useful material for the insert 200, as it is lightweight and easily obtainable, but other materials may be used such as glass, cardboard, or metals. Preferably the insert includes a plurality of regions (e.g. 202*a* and 202*b* in FIG. 2), each region may be sized such that a large unused ball of yarn may fit snuggly within each region. The outer edges of each region may be elevated. This enables each region to be bowl shaped, such that a ball of yarn may naturally sit within it. For example, as depicted in FIG. 2, along the edges of the two regions 202*a* and 202*b*, the region are elevated. The insert 200 may have any number of regions to accommodate the needs of the knitter.

As shown on FIG. 2, the regions in the insert 200 may be separated by an elevated wall 204 formed along, the spine, or the boundary between the two regions of the insert. The elevated wall may extend higher than the elevated outer edges of each region. For example, as depicted in FIG. 2, the insert 200 is separated by elevated wall 204 that extends higher than the outer edges of each region. The elevated wall 204 is positioned along the boundary of the two regions, region 202*a* and region 202*b*. Preferably the elevated wall 204 may include a ruler 205, or measuring marks, on one or both sides of the elevated wall 204, facing one or both of the regions. Such a ruler 205 may display units of measure, such as inches or centimeters, in order to advantageously enable quick measuring of yarn or other knitting materials.

Figure 3A:
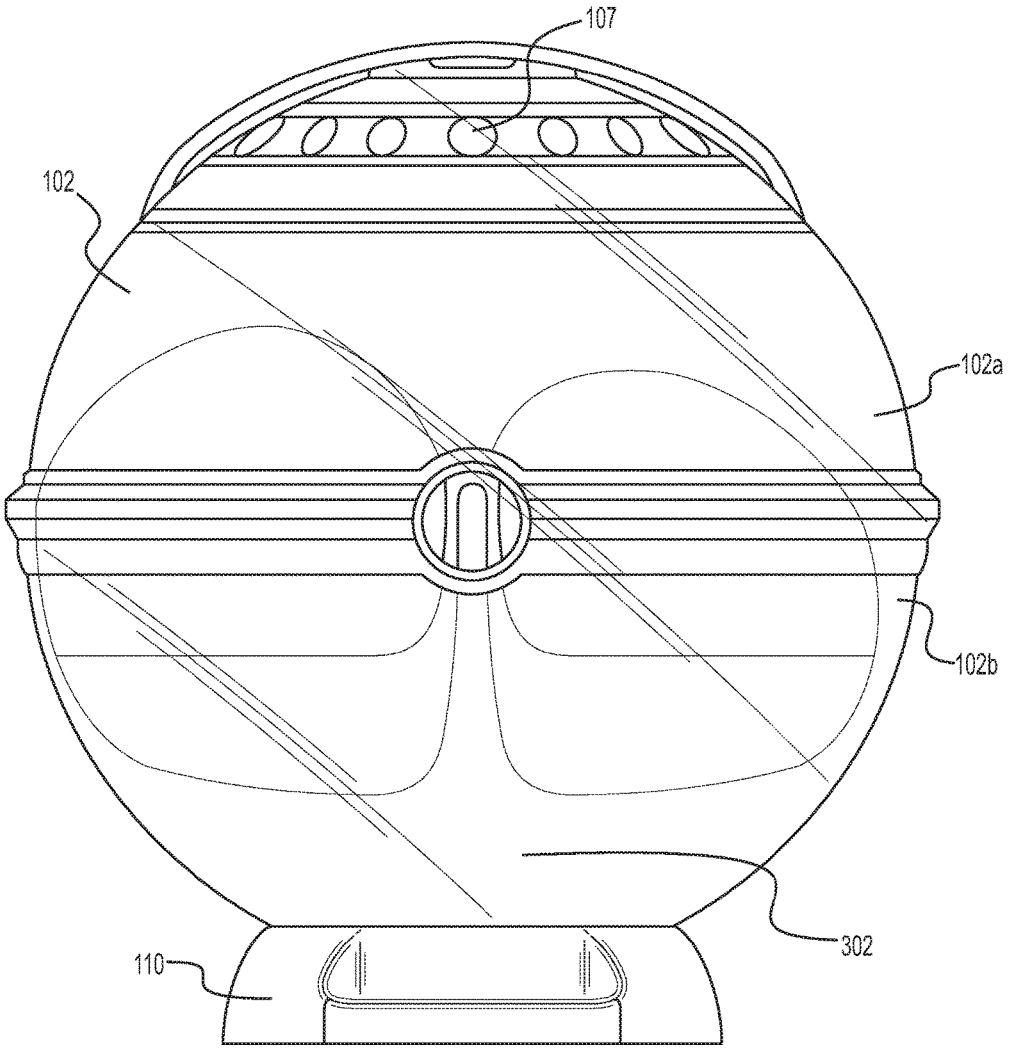
FIGS. 3A and 3B illustrate an embodiment of the yarn-carrying and dispensing apparatus that includes the insert placed inside the yarn-carrying portion.
Figure 3B:
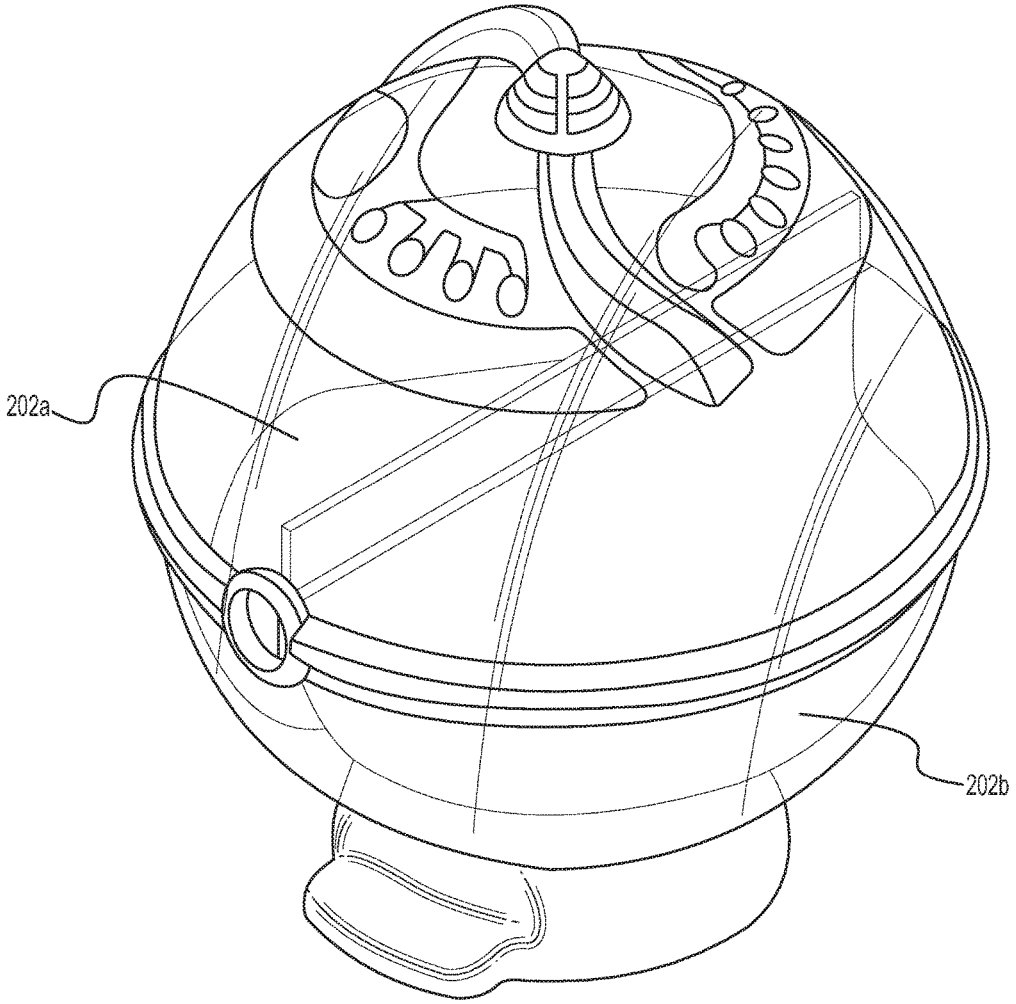

As depicted in FIG. 3A, the insert may fit snuggly within the bottom portion 102*b* such a plethora of balls of yarn may be contained within each region, (e.g. 202*a* and 202*b*) within the yarn-carrying portion 102 on the insert 200. The yarn dispensing holes or openings 106, will be positioned such that a yarn may exit or dispense from either region (202*a* or 202*b*) simultaneously. This configuration afford the knitter greater flexibility. Additionally, as shown in FIG. 3A, there may be a cavity 302 beneath the insert 200 and the bottom portion 102*b*, as the cavity 302 lies within the yarn carrying portion 102. Such a cavity 302 may also be utilized for storing needles or other knitting materials. FIG. 3B illustrates a yarn-carrying portion containing an insert, but not any balls of yarn.

Figure 4A:
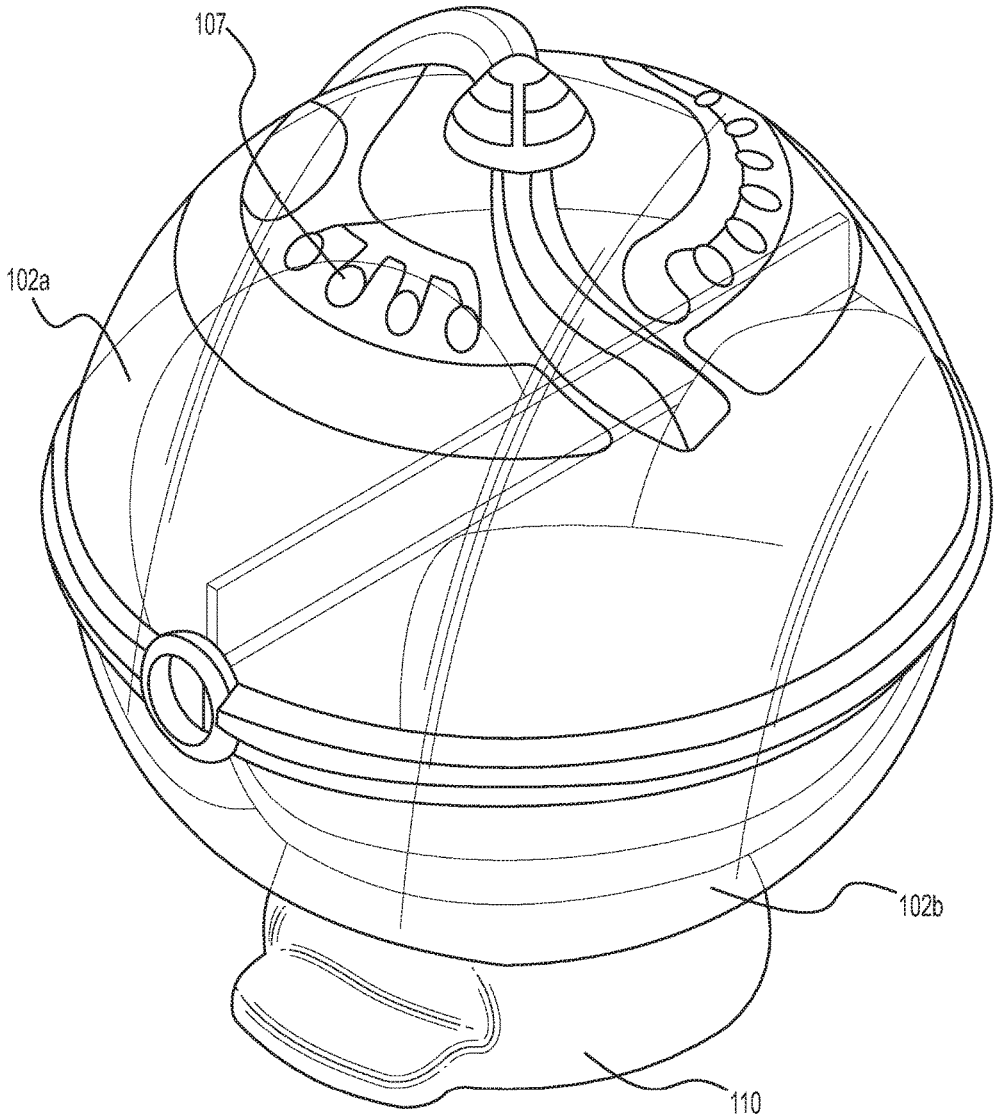
FIGS. 4A and 4B illustrate different views of the yarn-carrying and dispensing apparatus of the current invention.
Figure 4B:
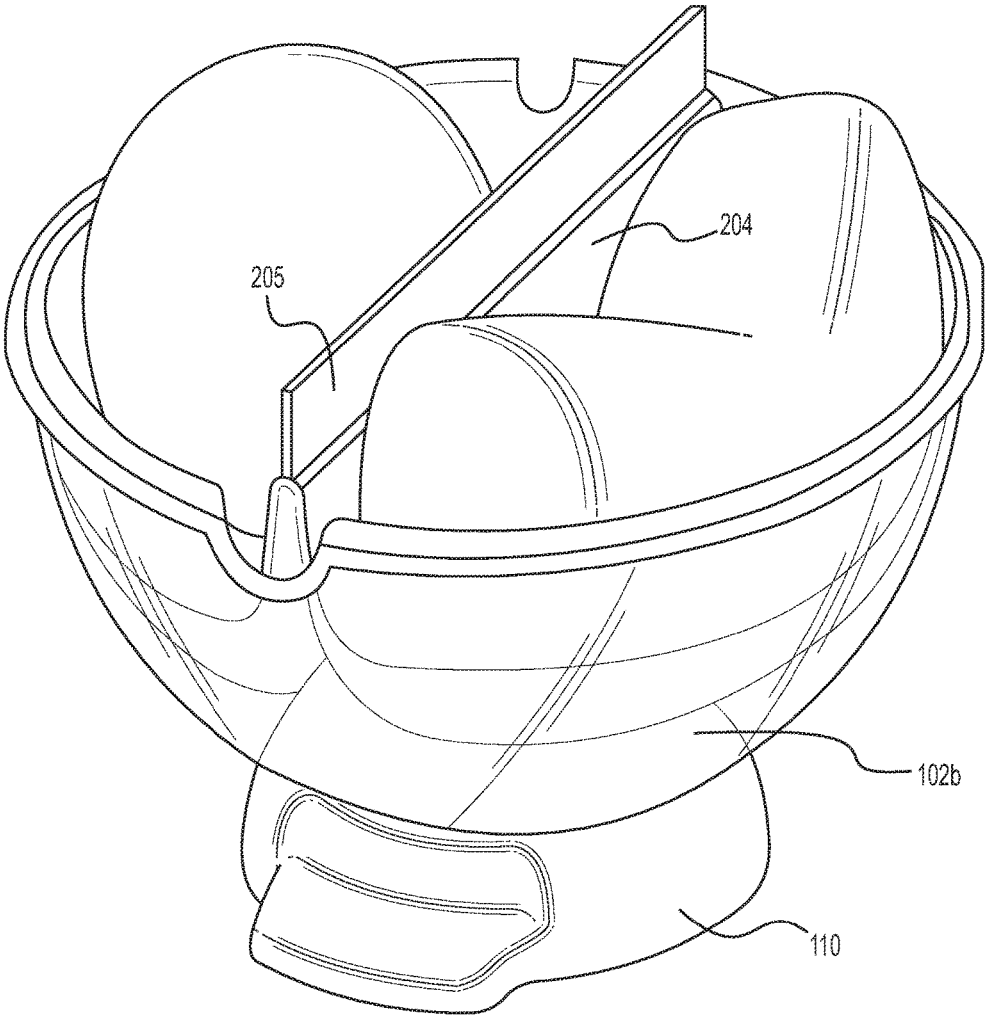
Figure 6:
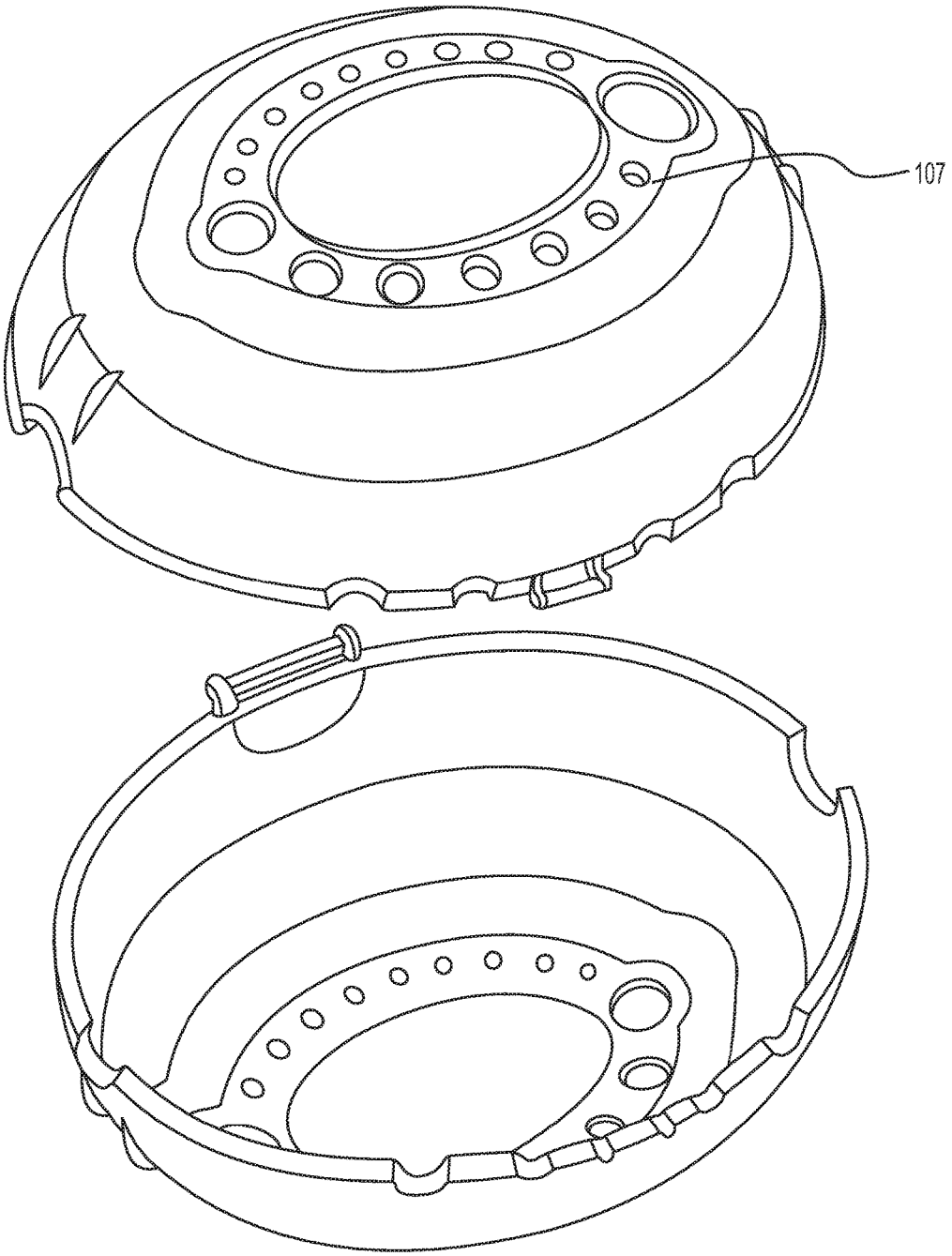
FIG. 6 further illustrate needle openings in the yarn-carrying and dispensing apparatus.

FIGS. 4A and 4B illustrate different views of the same embodiment of yarn-carrying and dispensing apparatus of the current invention. As shown in FIG. 4A, where there are no yarn dispensing holes provided along the joining of the top portion 102*a* and the bottom portion 102*b*, yarn may be threaded from a ball of yarn sitting on the inside of the yarn-carrying portion through the needle openings 107. Needle openings 107 provided in the top portion 102*a* of the yarn-carrying portion is further illustrated in FIG. 6. Further, needles which are currently not being used by the knitter may be placed within the plurality of the need openings 107, so that the knitter may organize his or her needles with threading yarn out of the other openings in the yarn carrying portion. This configuration is advantageous because the knitter may organize all of the multiple types of yarn, and needles in one convenient place while knitting.

Figure 5A:
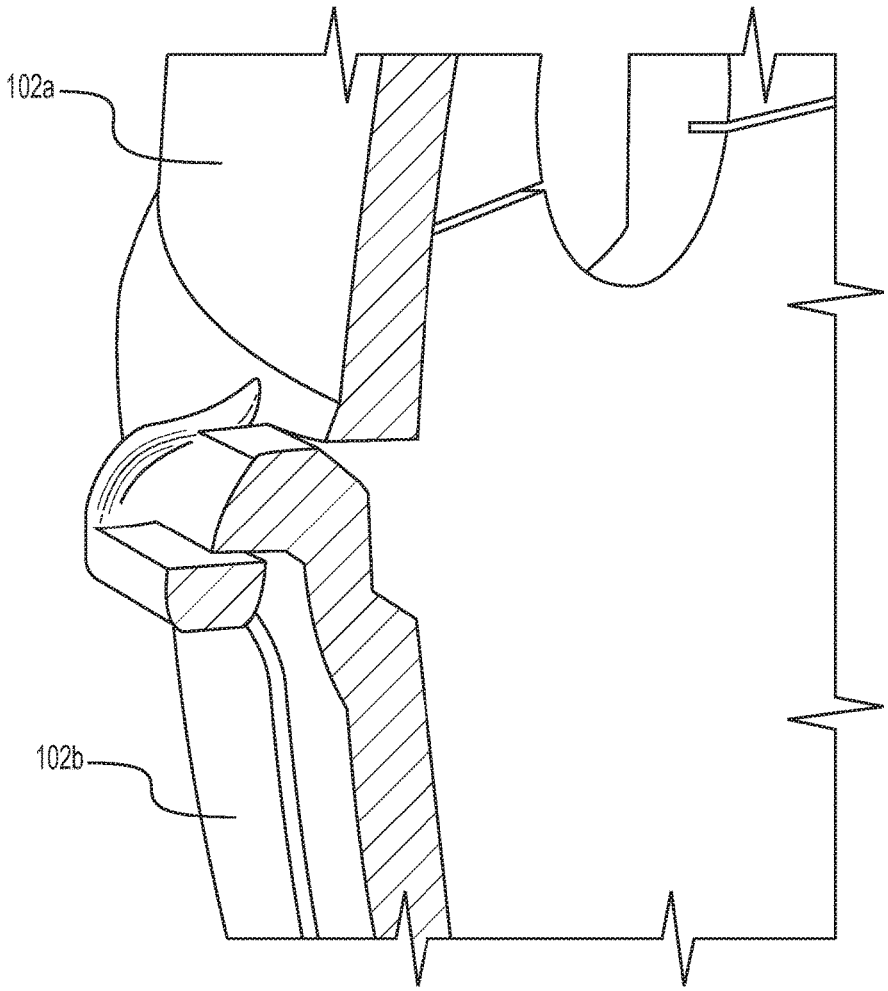
FIGS. 5A and 5B illustrate the locking mechanism for securing the top and bottom portions of the yarn-carrying portion.
Figure 5B:
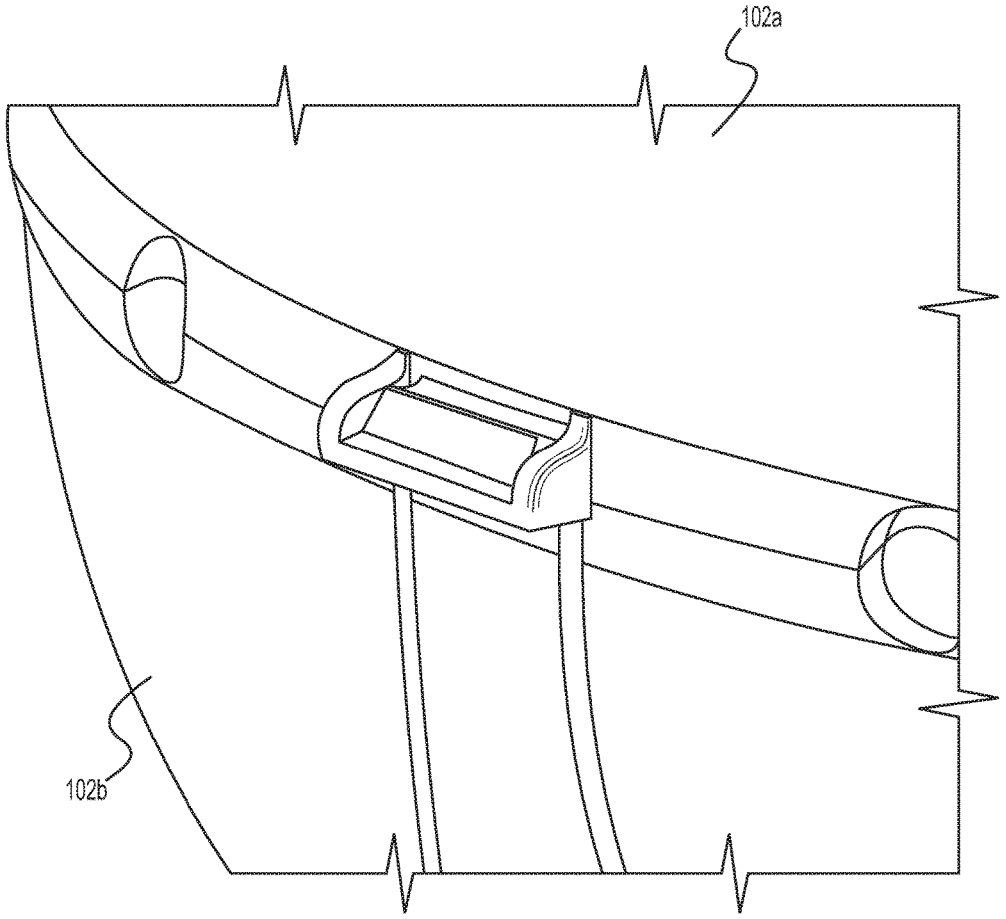

The yarn-carrying top and bottom portions 102*a* and 102*b* may be secured to each other with a help of a lock system, as is illustrated in FIGS. 5A and 5B. Such lock system enables the top portion 102A to snap into the bottom portion 102B. The locking apparatus may be molded, or inserted into the top and bottom portions. The edge of the bottom portion 102*b* is indented in the lock apparatus, so the edge of the top portion 102A can fit within the indentation if the two portions are closed together with sufficient pressure. Once the top portion is locked into the bottom portion, a protruding region of the bottom portion can be pulled outward in order to release the top portion. This enables the top and bottom portion to be unlocked and for the yarn carrying portion to be opened as to, for example, allow balls of yarn to be inserted into the yarn carrying portion. The lock system may also comprise a latch, hook, or any other mechanism capable of securing the yarn-carrying portions 102*a* and 102*b* in place when the hinge is closed.

Figure 7:
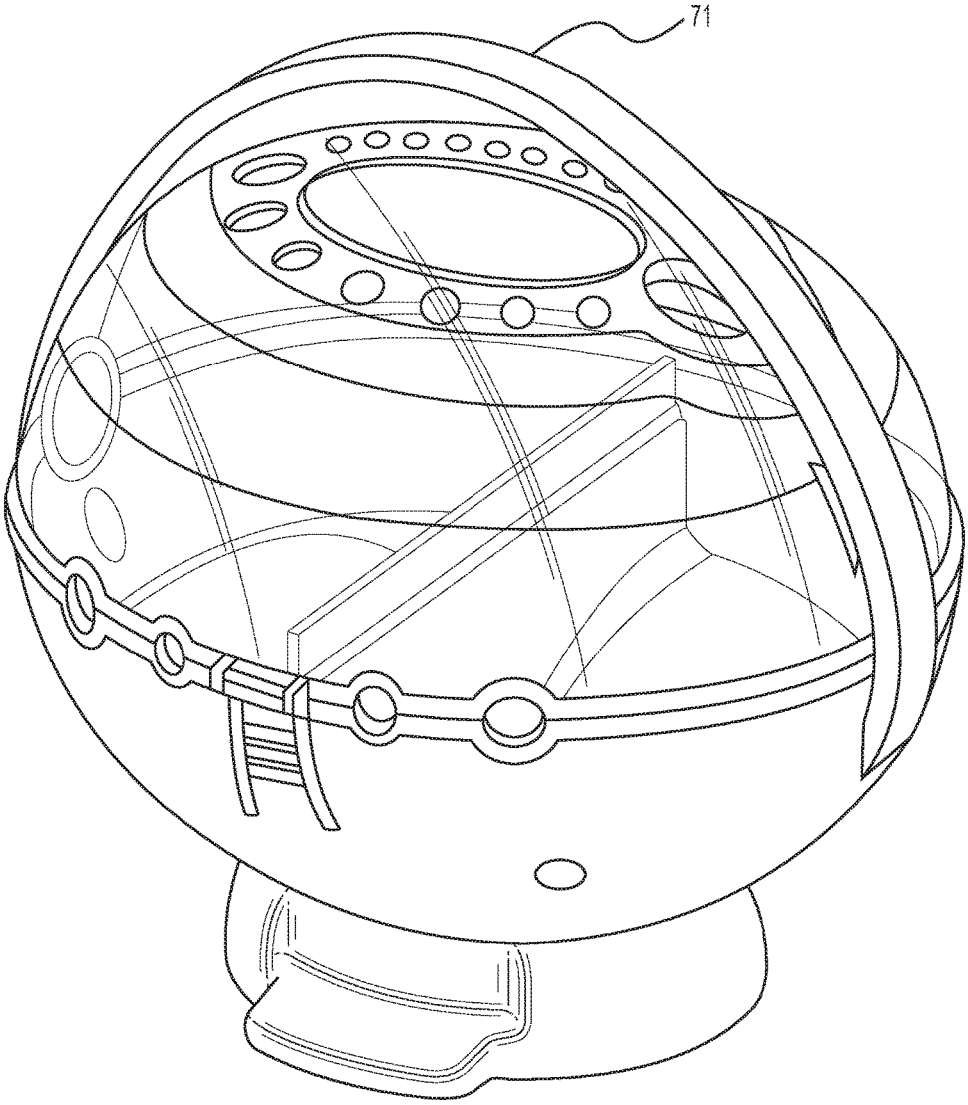
FIG. 7 illustrates a yarn-carrying strap connected to the yarn-carrying portion.

FIG. 7 shows a carrying strap 71 which may be connected to the yarn-carrying portion. The carrying strap 71 may be composed of plastic, polyester, or any suitable material. The strap may connect to groves in the outer surface of the yarn-carrying portion, and may include a ruler or measurement markings for making it easier for the knitter to gauge his or her measurements when knitting. When the yarn-carrying portion is detached from the base portion (110 as shown in FIG. 1), the carrying strap 71 enables a knitter to freely move about with the yarn-carrying portion.

Figure 8:
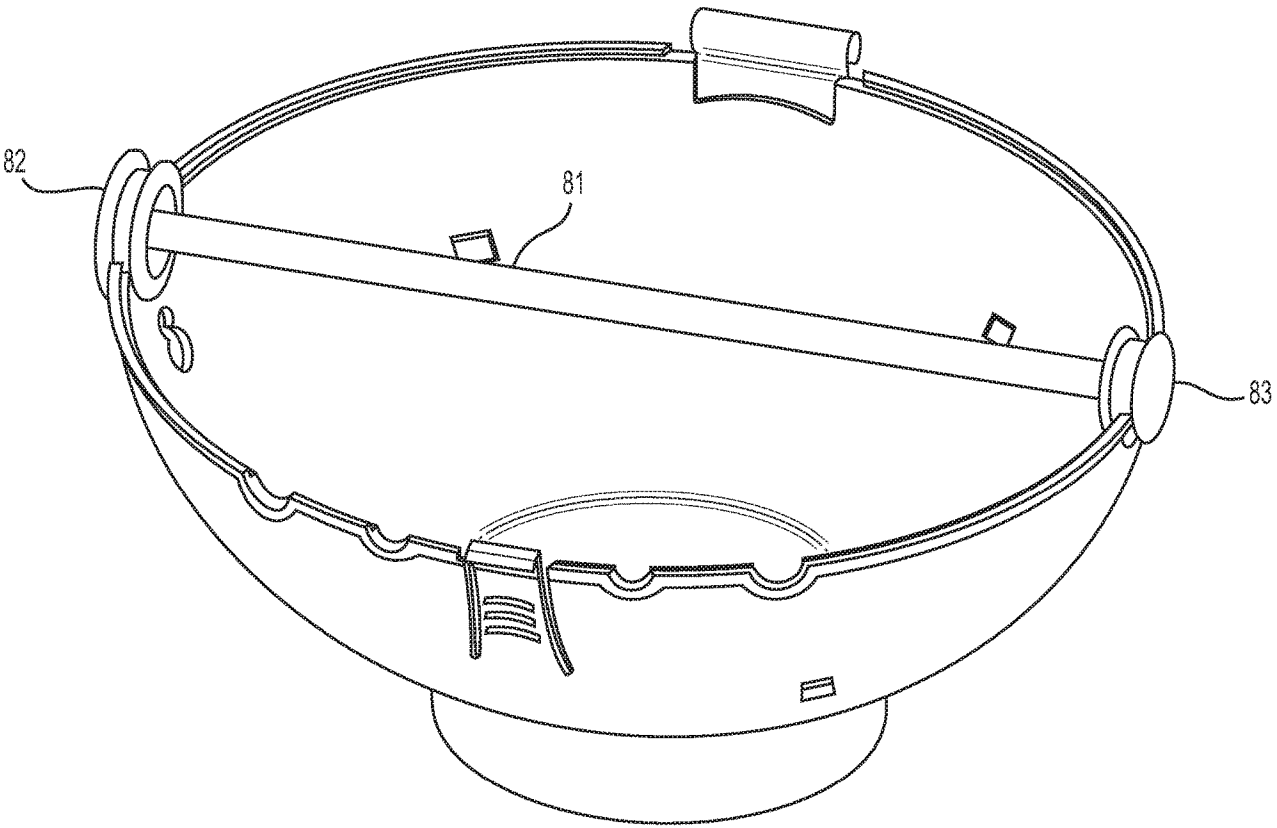
FIG. 8 illustrates a skein and cone tool for more efficiently dispensing yarn spooled on skeins, cake, or cone, or similar types of arrangements.
Figure 9:
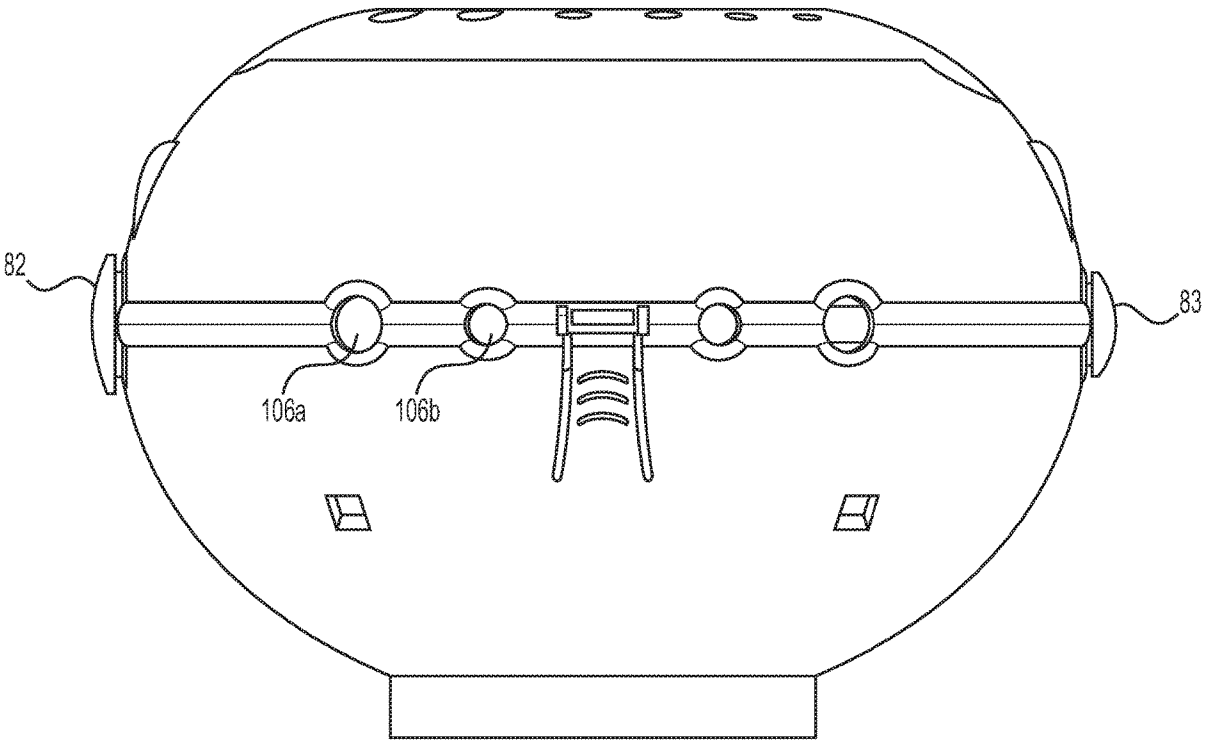
FIG. 9 illustrates further view of the skein and cone tool for more efficiently dispensing yarn spooled on skeins, cake, cone, or similar types of arrangements.

FIGS. 8 and 9 illustrate different views of a skein and cone tool for more efficiently dispensing yarn spooled on skeins, cake, or cone, or similar types of arrangements, out of the yarn-carrying portion. The skein and cone tool, comprises a rod 81, and detachable wheels 82 and 83, as shown in FIG. 8. The rod 81, and wheels 82, and 83, may be made of any suitable hard material, such as plastic. A skein of yarn, which is a ball of yarn formed into oblong shape, may be speared or otherwise pierced by the rod 81. Alternatively or additionally, a cone of yarn, which is a long thread of yarn wrapped tightly wrapped around a conical cardboard cylinder (or another suitable material) may be speared by the rod 81. Other configurations of yarn may be speared on the rod 81, such as a cake, a ball, etc. Spearing, or otherwise piercing, the skein, cone, cake, or other configuration of yarn enables the skein, cone, cake, or other configuration of yarn to freely rotate about the rod 81.

Once the skein, cone, cake, or other configuration of yarn, has been speared by rod 81, the knitter may attach the rod 81 to the wheels 82 and 83. The wheels are arranged to fit in between the top and bottom portion of the yarn-carrying portion, such that when the top and bottom portion of the yarn-carrying portion are snapped together, as shown in FIG. 9, the skein and cone tool sits securely between the top and bottom portion of the yarn-carrying portion. The skein and cone tool may advantageously be inserted into the yarn-carrying portion, in lieu of the removable insert (i.e. 200 as shown in FIG. 2). The enables the skein, cone, cake, or other configuration of yarn, which has been speared by the rod 81 and inserted into the yarn-carrying portion, to be freely rotated about the rod 81, so that the knitter can efficiently dispense yarn out of the yarn-dispensing holes 106*a* and 106*b*, as shown in FIG. 9, while maintaining the shape of the skein, cone, cake, or other configuration of yarn.

Multiple skeins or cones, for example, may be simultaneously speared around the rod 81, with the thread of each skein or cone arranged to be drawn out of different dispensing holes 106*a* and 106*b*. Further, the yarn dispensing holes 106*a* and 106*b* may be different sizes to accommodate the different sized threads of yarn for each different skein, cone, cake, or other configuration of yarn speared around the rod 81. The skein and cone tool thus enables the knitter to efficiently dispense yarn from multiple configurations of yarn (e.g. multiple skeins, cones, cakes, etc.) while maintaining the organization of the multiple configurations of yarn. Furthermore, the mobile nature of the yarn-carrying portion configured with the skein or cone tool provides the mobile knitter with a very organized, flexible, and adaptable knitting apparatus.

The terms and descriptions used herein are set forth by way of illustration only and are not meant as limitations. Those skilled in the art will recognize that many variations are possible within the spirit and scope of the invention.

What is claimed is:

1. A yarn-carrying and dispensing apparatus, comprising a substantially hollow yarn-carrying portion that accommodates at least one ball of yarn, the yarn-carrying portion having a top portion, and bottom portion, wherein the top portion and bottom portion are connected to each other by one of a joint or a hinge;

a disk shaped removable insert adapted to fit inside the yarn-carrying portion, the removable insert having a dividing wall formed on a surface of the removable insert, so that at least one ball of yarn can sit on the surface of the removable insert on either side of the dividing wall; and an annular shaped collar portion, the collar portion adapted to be removably secured to a base portion for allowing the yarn-carrying portion to sit on a surface.

2. A yarn-carrying and dispensing apparatus of claim 1, wherein the yarn-carrying portion includes one or more yarn dispensing holes through which the yarn is dispensed from the yarn-carrying portion.

3. The yarn-carrying and dispensing apparatus of claim 1, wherein the circumference of the removable insert is specified so that the removable insert fits securely along the inner circumference of the bottom portion when placed in the yarn-carrying portion.

4. The yarn-carrying and dispensing apparatus of claim 1, wherein the yarn-carrying portion further comprises a storage cavity positioned beneath the removable insert and the bottom portion when the removable insert is fitted securely in the yarn-carrying portion.

5. The yarn-carrying and dispensing apparatus of claim 1, wherein the top portion includes a plurality of needle openings.

6. The yarn-carrying and dispensing apparatus of claim 5, wherein an outer surface of the top portion displays a needle size corresponding to each of the plurality of needle openings.

7. The yarn-carrying and dispensing apparatus of claim 6, wherein the displayed size of the plurality of needle openings correspond to one of a contemporary U.S. Size, a contemporary U.K./U.S. Metric Range, or a European Metric Range.

8. The yarn-carrying and dispensing apparatus of claim 5, wherein the plurality of needle openings are arranged along a circular line surrounding an upper curvature of the top portion.

9. The yarn-carrying and dispensing apparatus of claim 8, wherein the plurality of needle openings are ordered from smallest to largest in diameter along the circular line.

10. The yarn-carrying and dispensing apparatus of claim 2, wherein the one or more yarn dispensing holes are formed in between the joining of the top portion and bottom portion.

11. The yarn-carrying and dispensing apparatus of claim 1, wherein the removable insert includes one or more regions depressed into the surface of the removable insert, so that a ball of yarn may sit securely within each region.

12. The yarn-carrying and dispensing apparatus of claim 1, wherein a ruler is formed on the dividing wall.

13. The yarn-carrying and dispensing apparatus of claim 2, wherein a plurality of yarn dispensing holes are aligned to each side of the dividing wall of the removable insert when the removable insert sits securely in the yarn-carrying portion, so that yarn may dispense yarn from a ball of yarn sitting on either side of the dividing wall.

14. The yarn-carrying and dispensing apparatus of claim 13, wherein at least two of the plurality of yarn dispensing holes are of a different circumference.

15. The yarn-carrying and dispensing apparatus of claim 1, wherein the top portion and the bottom portion are secured by a locking mechanism, wherein the locking mechanism prevents the top and bottom portion from opening when sufficient pressure is applied to the top and bottom portions toward one another.

16. The yarn-carrying and dispensing apparatus of claim 1, wherein the yarn-carrying portion is an oval shaped.

17. The yarn-carrying and dispensing apparatus of claim 16, wherein the yarn-carrying portion is eight inches long and six inches wide.

18. The yarn-carrying and dispensing apparatus of claim 1, wherein the yarn-carrying portion is made of one of plastic, glass, cardboard, and metal.

19. The yarn-carrying and dispensing apparatus of claim 1 further comprising a carrying strap, wherein the carrying strap contains ruler markings.

20. A yarn-carrying and dispensing apparatus, comprising a substantially hollow yarn-carrying portion that accommodates at least one ball of yarn, the yarn-carrying portion having a top portion, and bottom portion, wherein the top portion and bottom portion are connected to each other by one of a joint or a hinge; wherein the yarn-carrying portion includes one or more yarn dispensing holes through which the yarn is dispensed from the yarn-carrying portion; and a skein and cone tool adapted to fit inside of the yarn-carrying portion, the skein and cone tool comprising a rod and two removable wheels, each removable wheels configured to fit securely between the top and bottom portion, and to connect to each end of the rod; wherein the skein and rod tool is adapted to stab one of a skein or cone of yarn, such that the skein or cone of yarn may rotate about the rod when yarn from one of the skein or cone of yard is dispensed through the one or more yarn dispensing holes in the yarn-carrying portion.

* * * * *